United States Patent [19]

Snyder, Jr.

[11] 4,365,435

[45] Dec. 28, 1982

[54] PORTABLE SIGN

[75] Inventor: H. Kent Snyder, Jr., River Forest, Ill.

[73] Assignee: Chicago Display Company, Chicago, Ill.

[21] Appl. No.: 203,701

[22] Filed: Nov. 3, 1980

[51] Int. Cl.[3] ..... G09F 15/00; G09F 7/00; E04G 3/00

[52] U.S. Cl. ..... 40/608; 40/602; 248/289.3

[58] Field of Search ..... 40/602, 608, 606, 10 R, 40/16.4, 610; D20/41; 248/160, 226.4, 289.3

[56] References Cited

U.S. PATENT DOCUMENTS

| | | | |
|---|---|---|---|
| 1,532,865 | 4/1925 | Beck | 40/608 |
| 2,454,648 | 11/1948 | Green | 40/602 |
| 4,032,248 | 6/1977 | Parduhn et al. | 40/608 |
| 4,248,001 | 2/1981 | Feuvray | 40/602 |

*Primary Examiner*—Gene Mancene
*Assistant Examiner*—Michael J. Foycik, Jr.
*Attorney, Agent, or Firm*—Hume, Clement, Brinks, Willian & Olds, Ltd.

[57] ABSTRACT

The portable sign includes a display frame, a base having shafts for pivotably mounting the display frame on the base, first and second stops, one positioned on one side of the base, the other positioned diagonally across on the opposite side of the base. The spring structure has two springs, each engaging and winding only in one direction to prevent unwinding of the spring. Upon application of a force such as the wind to the display frame, the first spring engages the adjacent stop and tightens while the second spring disengages from the adjacent stop and rotates away from the stop. This allows deflection of the frame while protecting the spring from being unwound.

A second embodiment of the portable sign includes a display frame, a base having shafts for pivotably mounting the display frame on the base, and a spring mechanism for biasing the display frame including a first bracket for retaining a spring, a spring, and a second bracket for slidably retaining a spring. The spring mechanism is mounted at one end to the display frame and the other end the base so that when a force deflects the display frame, the spring flexes and slides through the second bracket for slidably retaining a spring and when the force ceases, the spring unflexes and shortens and acts to restore the display frame to an upright position.

10 Claims, 10 Drawing Figures

PORTABLE SIGN

BACKGROUND OF THE INVENTION

Portable signs are particularly useful for advertising products and services outdoors, such as advertising gasoline prices or tire sales at service stations, or displaying menus in front of restaurants. Their special advantage is portability, but along with this advantage comes the disadvantage of the ease with which they can be toppled by gusts of wind. In the past, various spring mechanisms have been employed to allow the display frame to pivot to deflect the wind. U.S. Pat. No. 3,662,482 shows one such attempt in which a display frame is mounted onto a pair of massive coiled springs which support the weight of the display frame; these springs are mounted onto a base made from tubular steel members. U.S. Pat. No. 1,750,118 discloses another variety of spring mechanism. One form of this mechanism uses a series of tension springs to connect the bottom of the display frame to the leg. A second form of the sign uses torsion springs mounted on pivot bolts to bear on the sign.

Another spring mechanism is shown in Beck, U.S. Pat. No. 1,532,865, but this sign is designed to be permanently implanted in a road and yield to let cars pass over it. Its spring mechanism employs dual torsion springs, oppositely coiled and mounted between the mounting support and the display frame.

SUMMARY OF THE INVENTION

The present invention provides two embodiments of a portable sign suitable for outdoor use which deflects wind efficiently to prevent toppling. The first embodiment accomplishes this by supporting the display frame on pivotable mounts and using a spring system on both sides of the display frame near the mounts. The spring system in this first embodiment includes two torsion springs which oppose each other so that only one spring engages in each direction. Furthermore, each spring engages only in the direction in which it is wound, so that the spring is never unwound from its rest state. The advantages of this design include its operational simplicity and quietness; its enclosed springs, which help ensure safety; and its ease of assembly.

In the second embodiment, pivotable mounts also support the display frame's weight, but the spring mechanism is different. The spring mechanism of this second embodiment includes a spring which is slidably held in place by two brackets mounted to the display frame and base members. This allows the spring to bend more yieldingly than if the springs were rigidly affixed between the two brackets. Therefore less stress is placed on the spring which increases the spring's lifespan. Moreover, this spring mechanism is quite easily assembled, which simplifies operation and repair.

In both embodiments, the display frame is pivotably mounted at either side to the base. In both cases, the springs are placed adjacent to these mounts. This provides several advantages. First, the springs do not support the weight of the display frame, thereby removing one stress on the springs. Also, the spring mechanism is designed so that the springs do not operate in a direction which forcibly unwinds them. This increases the spring's life while simultaneously allowing the use of lighter weight, less expensive springs. Further, in the first embodiment, the springs are covered, which increases the safety of the sign. Finally, by placing the springs outside the pivot mounts in the second embodiment, the springs are easily accessible should repairs become necessary. Complete dismantling of the sign during spring repairs could thereby be avoided.

Further features and advantages of the invention will become evident upon reference to the following detailed description and the attached drawings.

DETAILED DESCRIPTION OF THE PREFERRED EMBODIMENTS

Figure 1:
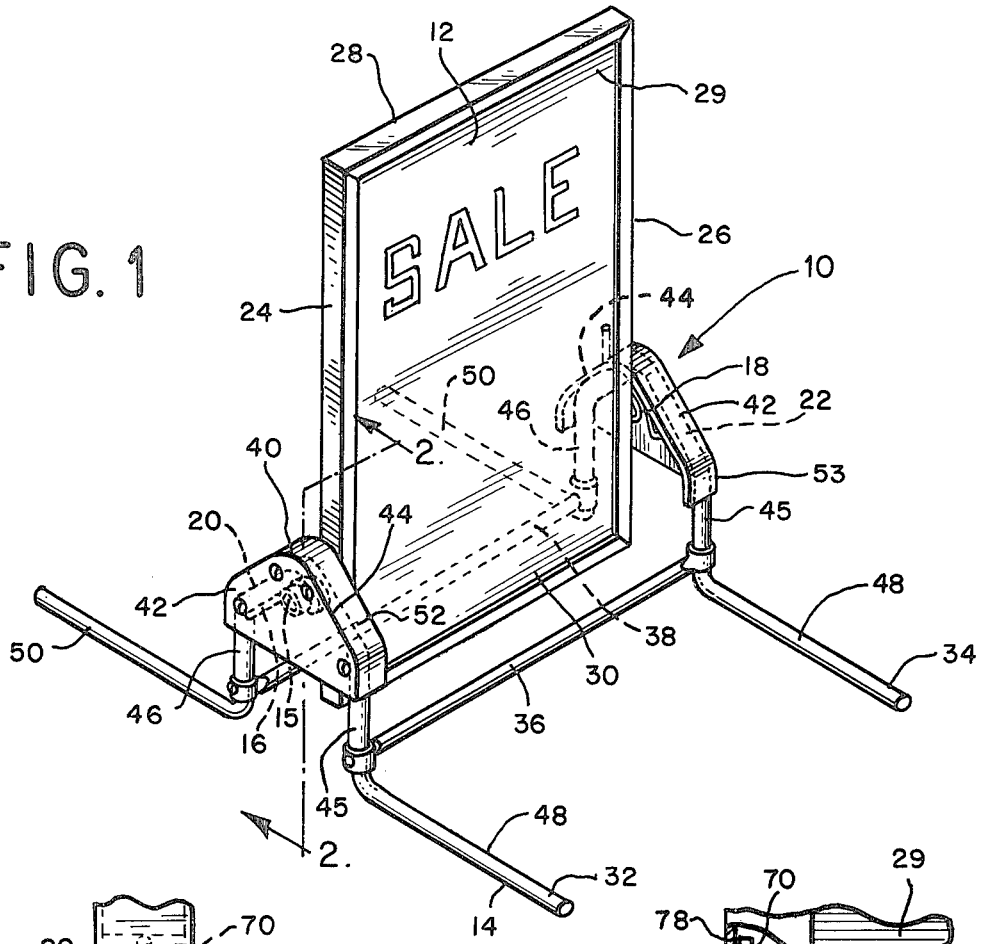
FIG. 1 is a perspective drawing of a first preferred embodiment of the portable sign of this invention shown in an upright position.

FIG. 1 shows, as a first preferred embodiment of the present invention, a portable sign generally designated by the numeral 10. The portable sign 10 includes a display frame 12, a base 14, a pair of shafts 15 for pivotably supporting the display frame 12 on the base 14, a pair of coiled torsion springs 16,18 and a pair of stops 20,22 located on opposite sides of the display frame 14 diagonally opposed from each other.

Figure 3A:
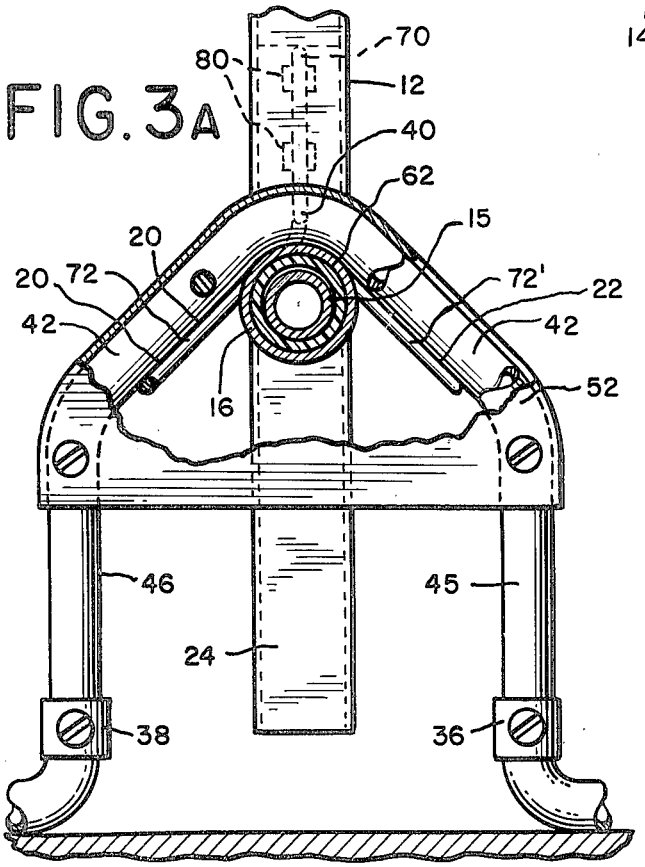
FIG. 3*a* is a side elevational view of the embodiment of FIG. 1, in partial cutaway, in which the display frame is in an upright position.
Figure 3B:
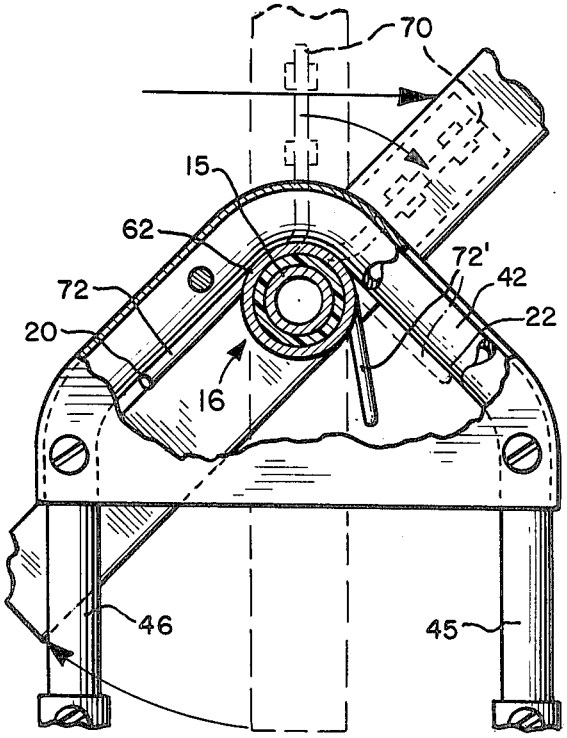
FIG. 3*b* is a side elevational view, corresponding to FIG. 3*a*, in which the display frame is shown deflected forward of an upright position.
Figure 3C:
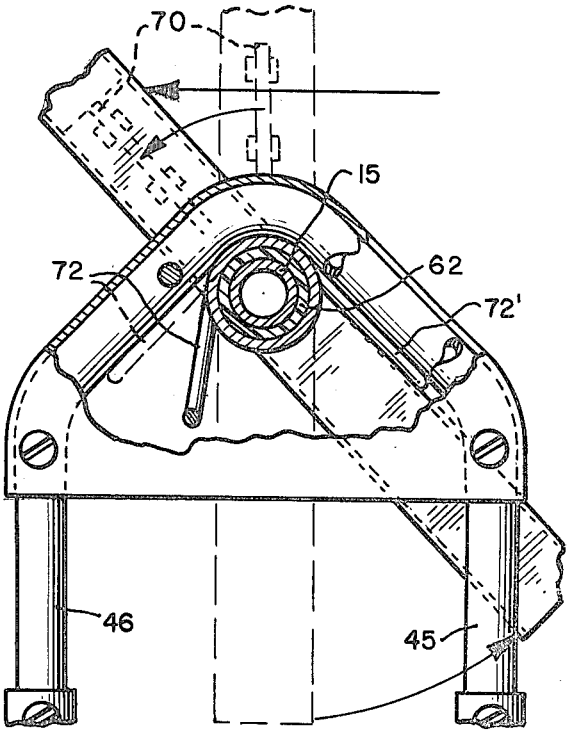
FIG. 3*c* is a side elevational view, corresponding to FIG. 3*a*, in which the display frame is shown deflected backward of an upright position.

The display frame 12 includes two uprights 24,26 which are connected by means for connecting the uprights, which may be, for example, two horizontal members 28,30 joining together the uprights 24,26 to define an area suitable for displaying notices or signs such as restaurant menus, gasoline prices, special sales, or for conveying information to passers-by. The horizontal members 28,30 may be solid or the upper member 28 may have slots for insertion of placards 29 into the display frame 12. Alternatively, the display frame may be any geometric shape which provides a suitable display area. The details of affixing the spring can be found below in the discussion of FIG. 3.

The base 14 may be, for example, a pair of connected bent steel tubular upright members 32,34 which form opposite sides of the base 14. The upright members 32,34 are connected and rigidified by a pair of cross-members 36,38 which extend between the upright members 32,34. Referring to one representative steel tubular member 32, it is made from a long, preferably hollow, steel tube, bent midway to form an apex 40. The first and second angularly extending portions 42,44 of the steel tubular member 32 define at the apex 40 an approximately right angle; the tubular member 32 is further bent to form third and fourth downwardly extending portions 45,46 and fifth and sixth outwardly and horizontally extending portions 48,50 which rest on the ground. In the embodiment shown, a cover 52,53 is secured to each tubular member 32,34 to cover the apex 40 and the springs 16,18. These covers 52,53 increase the safety of the portable sign because they help prevent children from inserting their fingers into the spring. Alternatively, the base may have single uprights which have stops rigidly affixed thereto, instead of being defined by the tubular portions 32,34 of the base 14.

Figure 2:
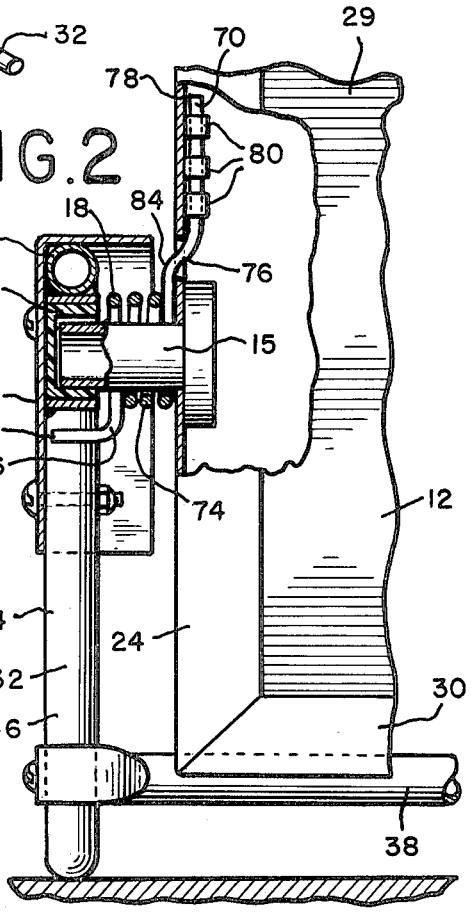
FIG. 2 is a sectional view of the left portion of the embodiment of FIG. 1, taken along lines 2—2 of FIG. 1.

As shown in FIG. 2, the display frame 12 is pivotably mounted to the base 14 by a pair of shafts 15, each of which is secured to a respective one of the display frame uprights 24,26 and is pivotably attached to the base 14. Each shaft 15 fits within a nylon bushing 62 which is rigidly affixed to the inside of the respective cover 52,53 so that it is positioned near the apex 40 of the legs. Alternatively, there may be a single shaft or the shaft may be rigidly affixed to the cover and inserted into a nylon bushing mounted to a hole drilled in the display frame upright. Each shaft 15 forms a fixed pivot point which transfers the weight of the display frame 12 directly to the base 14 so that the weight of the display frame 12 is not borne by the springs 16,18. Additionally, the nylon bushing 62 allows the display frame 12 to pivot with low friction and little noise.

Figure 4:
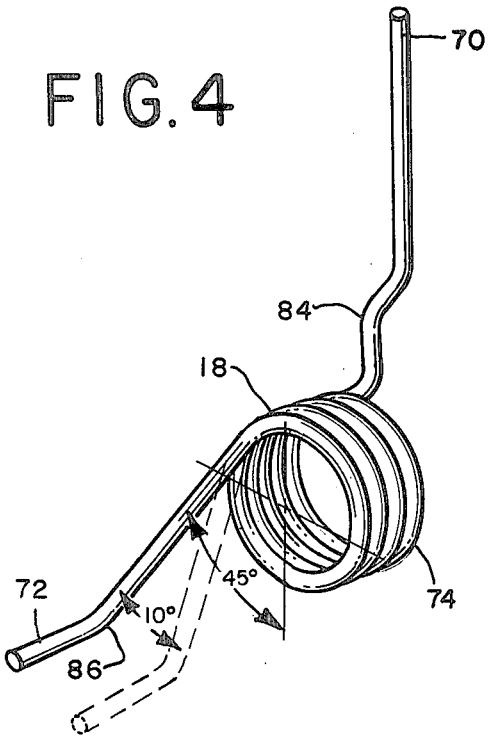
FIG. 4 is a perspective view of one of the springs of the embodiment of FIG. 1.

One of the springs 16,18 is mounted on each side of the display frame between the display frame 12 and the respective upright member 32,34 of the base 14. As shown in FIG. 4, each spring 16,18 includes a first end 70, a second end 72, and a plurality of spaced turns forming an intermediate coil 74. Each spring 16,18 is preferably made from 5/16 inch diameter coated steel wire, and is wound so that the intermediate coil 74 fits loosely over, but does not touch, the shaft 15 which connects the display frame 12 to the base 14. The second end 72 of the spring 16,18 when not mounted in the sign normally forms an approximately 30° angle with the vertical. When the spring 16,18 is mounted as shown in FIG. *3a*, it forms an approximately 45° angle with the vertical. This pre-loading feature causes the springs to resist equally and oppositely against the base 14 when the display frame 12 is in an upright position. Balancing the forces exerted by the springs 16,18 maintains the display frame 12 in an upright position when no external forces are acting on the display frame 12.

The first end 70 of the spring 16,18 is adapted for mounting in a bracket 78, which is rigidly mounted on the inside surface of each of the uprights 24,26, as shown in FIG. 2. Each bracket 78 has a plurality of ears 80 attached along both edges of the bracket 78, defining a channel therebetween. A dog leg 84 is formed between the intermediate coil 74 and the first end 70 of the spring 16,18 to facilitate insertion of the first end 70 of the spring 16,18 through an opening 76 in the display frame upright 24,26 to insure proper placement of the first end 70 for rigidly securing it to the display frame 12. The second end of the spring 72 has an arm 86 where the wire bends outward from the intermediate coil 74 so that the second end 72 of the spring 16 will resist against its adjacent stop 20 and engage with or disengage from the stop as described below when the display frame 12 is pivoted from an upright position. Each spring 16,18 is mounted to the display frame 12 by inserting its first end 72 into the respective opening 76 and sliding the intermediate coil 74 around the respective shaft 15. The first end 72 of the spring 16,18 is positioned in the channel formed between the ears 80 on the respective bracket 78. The ears 80 are then bent over the first end 72 of the spring 16,18 so that the spring 16,18 is rigidly affixed to the display frame 12.

Figure 5:
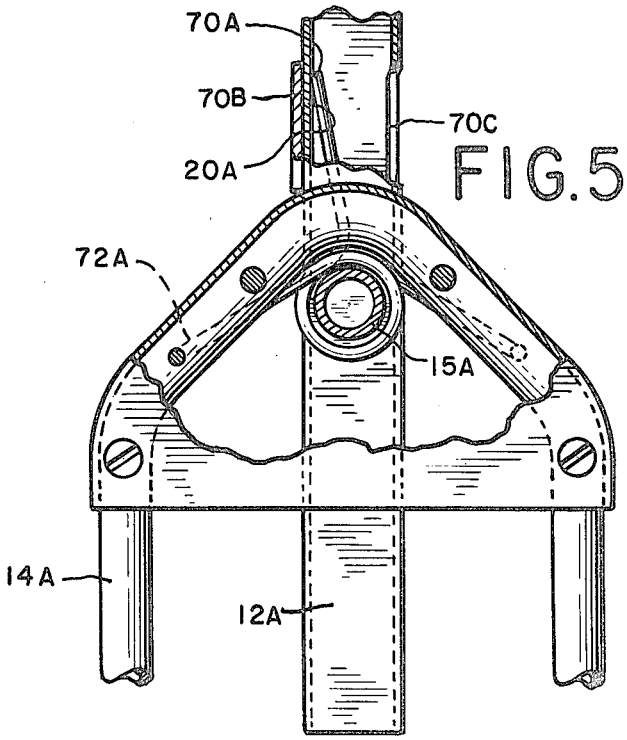
FIG. 5 is a front elevational view of the left portion of a sign similar to that of FIG. 1 showing an alternate structure for mounting the springs.

Alternatively, the stops can be mounted on the display frame 12 instead of on the base 14, as shown in FIG. 5. In this alternate embodiment, the first end 70A of the spring 16A,18A engages the stops 20A,22A and the second end 72A, instead of being free to move, is rigidly affixed to the base 14A. There is also a steel or reinforced shoulder 70B to prevent the spring from puncturing the sidewall of the display frame, and a window 70C to allow the first end 70A of the spring 16A, 18A to rotate freely within a 90° range. Additionally, a second cover may be provided to prevent children from inserting their fingers into the mechanism. This reverses the spring attachment configuration described above in connection with FIGS. 1–14, but does not change the operation of the sign.

FIGS. *3a, 3b,* and *3c* illustrate the portable sign of FIG. 1 in operation. In FIG. *3a,* the display frame 12 is shown in an upright position. The second end 12 of the first spring 16 is shown in its pre-loaded position, resisting against its adjacent stop 20, defined here by the first angularly extending portion of the leg 42 on the base 14. The second end 72' of the second spring 18 is also shown in its pre-loaded position, resisting against its adjacent stop 22, defined here by the first angularly extending position of the leg 42 on the opposite side of the base 14.

As a force is exerted in one direction against the display frame 12, as shown in FIG. *3b,* the resistance of the second end 72 of the first spring 16 against its adjacent stop 20 increases, and when the force is great enough, the display frame 12 begins to pivot in one direction from an upright position. At the same time, the intermediate coil 74 of the first spring 16 tightens. The second end 72' of the second spring 18 disengages and rotates away from its adjacent stop 22, defined by the second angularly extending portion of the leg 42 on the other side of the base 14. A greater force exerted against the display frame 12 will cause the display frame 12 to pivot further from an upright position the intermediate coil 74 of the first spring 16 to tighten further, and the second end 72' of the second spring 18 to rotate further from its stop 22. As the force against the display frame 12 lessens, the spring 16 will gradually untighten, causing the display frame 12 to restore itself gradually to an upright position, and the second end 72' of the second spring 18 to rotate toward and re-engage with its adjacent stop 22.

FIG. *3c,* illustrates how the sign operates when a force is exerted against the display frame 12 in an opposite direction from the force in FIG. *3b*. As the force is exerted against the display frame 12, the resistance of the second end 72' of the second spring 18 against its adjacent stop 22 increases. When the force is great enough, the display frame 12 begins to pivot in a second direction from an upright position, and at the same time, the second end 72 of the first spring 16 disengages and rotates away from its adjacent stop 20. If the force against the display frame 12 is increased, the display frame 12 will deflect further from the upright position, and at the same time the intermediate coil 74 of the second spring 18 tightens further, while the second end 72 of the first spring 16 rotates further away from its adjacent stop 20. As the force against the display frame 12 lessens, the spring 18 will gradually untighten, causing the display frame 12 to restore itself gradually to an upright position, and the second end 72 of the first spring 16 to rotate toward and re-engage with its adjacent stop 20.

It should now be apparent that this portable sign efficiently prevents toppling yet combines economical parts into a simple, clean design. Moreover, the springs do not support the display frame's weight. Finally, the torque created by deflection of the display frame is applied to the springs only in the direction in which they are wound, therefore they are never forcibly unwound, a feature which improves their effectiveness and lengthens their life.

Figure 6:
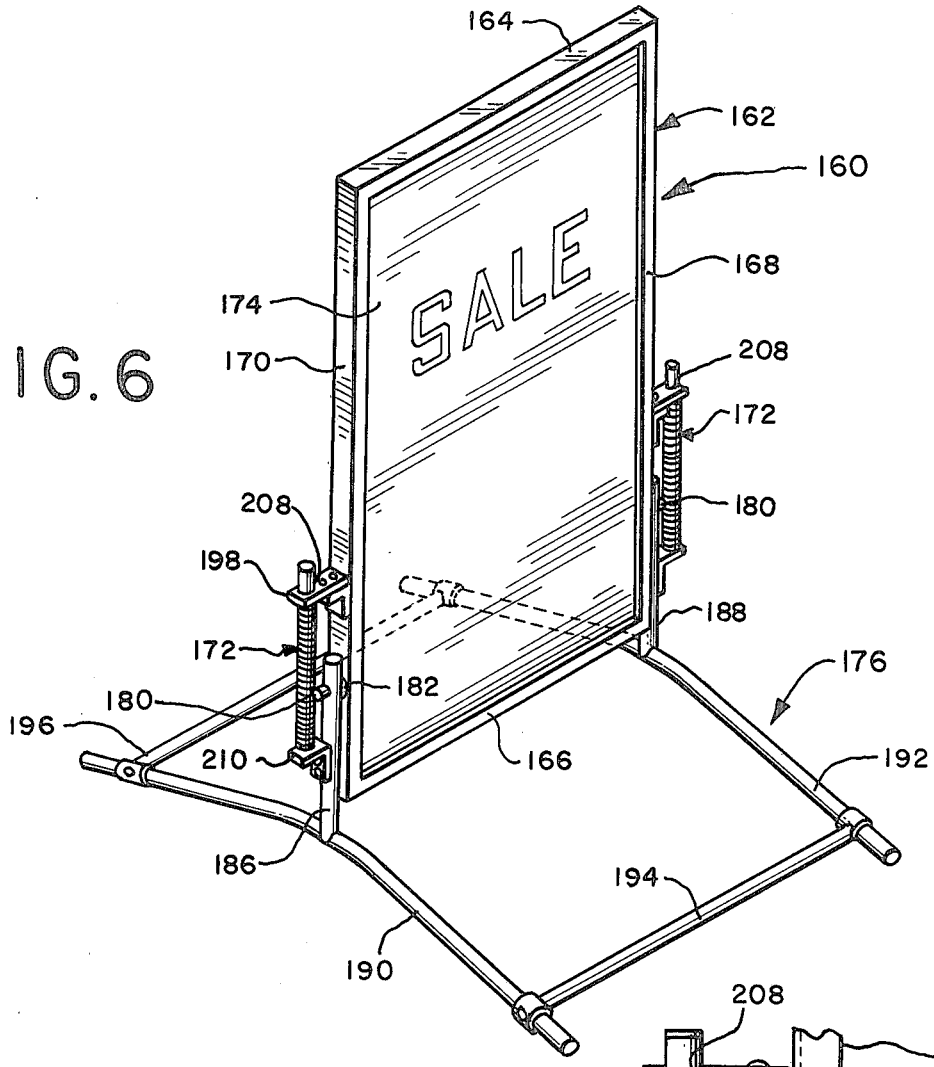
FIG. 6 is a perspective view of a second preferred embodiment of the invention.

A second embodiment of the invention is shown in FIG. 6. This second embodiment, generally designated 160, includes a display frame 162, a base 176, means for pivotably mounting the display frame 162 to the base 176, shown here as a pair of shafts 180, and at least one, but preferably two, spring assemblies 172.

The display frame 162 preferably consists of two horizontal members 164,166 attached to two vertical members 168,170 to form a large rectangular display area. Positioned inside the rectangle defined by the four members is a rigid backing 174 suitable for affixing posters, signs, or notices. Preferably, the backing is made from aluminum, sheet metal or some similar rigid and waterproof material. The upper horizontal member 164 may be solid, or it may have a slot for insertion of large placards.

Figure 7:
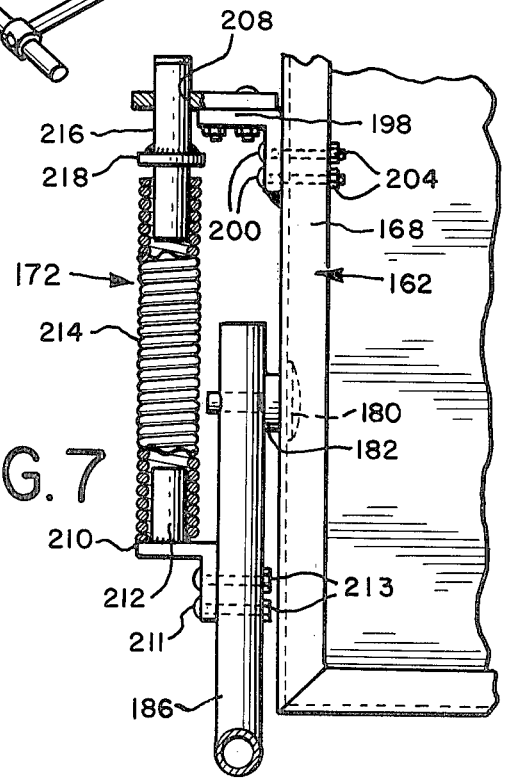
FIG. 7 is a front elevational view in partial cutaway of the spring mechanism of the sign of FIG. 6.

The display frame 162 is mounted to the base 176, by a pair of shafts 180; one end of each shaft 180 is welded to the inside of the display frame 162, as shown in FIG. 7. A washer 182 is positioned on each shaft 180 between a respective upright arm 186,188 of the base 176 and the vertical members of the display frame. The base 176 has two upright arms 186,188 welded to two legs 190,192 to form a T-shaped configuration. Two cross-supports 194,196 join the legs 190,192 rigidly together.

FIG. 7 shows a representative spring assembly 172. It consists of a first bracket 198, which is L-shaped and preferably made of steel and fixed by screws 200 held in position on a respective one of the uprights 168,170 by nuts 204. The first bracket 198 defines a circular aperture 208. Positioned below the first bracket, and vertically aligned therewith when the display frame is in an upright position, is a second bracket 210, mounted to a respective one of the uprights 186,188 by bolts 211 and nuts 213. Each second bracket 210 has means for retaining a spring 212, shown here as a pin 212 which is selected to fit slidably inside a spring 214. The spring 214 is preferably a tightly wound closed coil spring made from 11/32 inch steel wire, with the coil having a diameter of 1½ inches and a length of 12 inches. Alternatively, a leaf spring can be used. Slidably engaged within the spring 214 is a shaft 216, which is preferably 4 inches of 1⅛ inch diameter steel tubing having mounted on it a stop 218. In this embodiment, the stop 218 is a washer having an inside diameter slightly larger than the outside diameter of the shaft 216, and is welded onto the shaft 216. The stop 218 prevents the shaft 216 from sliding wholly inside the spring 214 or from being pulled out unintentionally. Alternatively, the first bracket 198 can also be affixed to the base, and the second bracket 210 secured to the display frame without departing from the spirit of the invention.

The spring assembly 172 is designed to allow the shaft 216 to move inward and outward in the aperture 208 in the first bracket 198 to reduce the stress put on the spring 214. This configuration also allows replacement of the springs without disassembling the entire sign.

Figure 8:
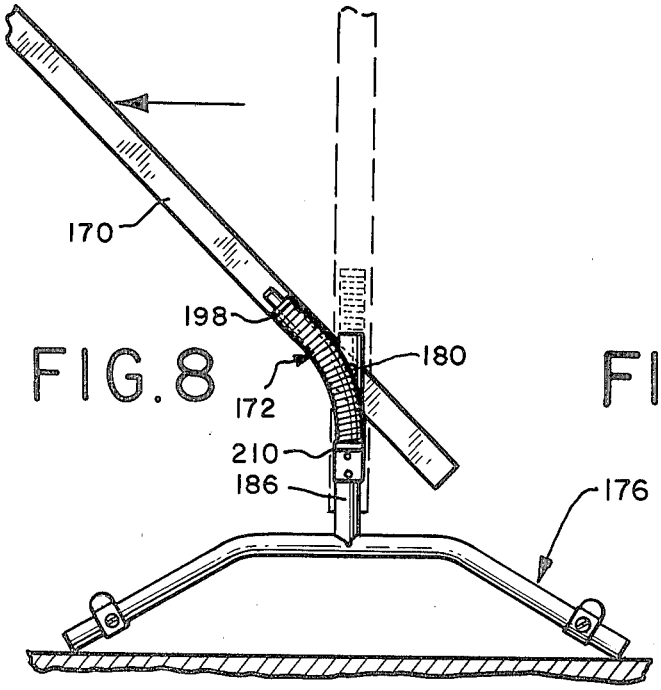
FIG. 8 is a side elevational view of the embodiment of FIG. 7 showing the display frame flexed backward of an upright position.

FIG. 8 shows the second embodiment of FIG. 6 in operation. When the portable sign 160 is in a resting position, the display frame 162 as well as the spring assembly 172 are in an upright position. As a force is applied in one direction, the display frame 162 pivots on its axis defined by the shafts 180, which connect the display frame 162 to the base 176. The amount of pivoting is controlled by the spring mechanism 172, which arcs when the display frame is deflected by a force. As the force increases, the spring 214 flexes more and the shaft 216 slides through the aperture 208, thereby reducing the stress placed on the spring 214. The greater the force exerted against the display frame 162, the greater the flexion in the spring 214 and the further through the aperture 208 the shaft 216 slides. When the force ceases to be exerted against the display frame, the spring 214 begins to restore itself and the display frame 162 back to the upright position, while the shaft 216 slides back through the aperture 208 until it reaches its original position. This design enables the sign to deflect efficiently the forces applied to the display frame while minimizing the force on the spring to prevent unduly stretching it.

It should be apparent from the description of the second embodiment that a portable display sign has been described which uses a spring mechanism wholly separated from the pivoting assembly to allow the sign to deflect the wind, but not support the sign. Moreover, the spring is slidably affixed at the ends to reduce the force exerted on the springs, to increase the efficiency of the sign, and to facilitate replacement of the springs without dismantling the entire sign.

Of course, it should be understood that various changes and modifications to the preferred embodiment described above will be apparent to those skilled in the art. For example, the length of the spring as well as the type of spring or wire used in making the spring can be changed as desired. It is therefore intended that all such changes and modifications be covered by the following claims.

I claim:

1. A portable sign comprising:

a display frame;

a base for supporting the display frame and having a front end and a rear end;

means for pivotably supporting the display frame on the base along a pivot axis;

first and second stops, the first stop positioned on one side of the base forward of the pivot axis, the second stop positioned on an opposite side of the base aft of the pivot axis, such that the second stop is diagonally opposite the first stop;

a first spring having a first end, a second end an an intermediate coil;

means for mounting the first spring between the display frame and the base, such that the second end engages the first stop and tightens the coil of the first spring when the display frame is pivoted forward of an upright position and the second end of the first spring disengages from the first stop when the display frame is pivoted backward from an upright position in order that the first spring and first stop cooperate to restore the display frame to an upright position when the display frame is tilted forward, without unwinding the first spring;

a second spring, having a first end, a second end, and an intermediate coil;

means for mounting the second spring between the display frame and the base, such that the second end engages the second stop and tightens the coil of the second spring when the display frame is pivoted backward from an upright position and disengages the second end of the second spring from the second stop when the display frame is pivoted forward from an upright position in order that the second spring and the second stop cooperate to restore the display frame to an upright position when the display frame is tilted backward without unwinding the second spring.

2. The portable sign of claim 1 wherein each of the first and second springs is concentric with the means for pivotably mounting the display frame to the base.

3. The portable sign of claim 1 or 2 wherein the means for pivotably mounting the display frame to the base comprises at least one shaft.

4. A portable sign comprising:

a display frame having first and second uprights defining first and second sides and means for interconnecting the uprights, such that the uprights define therebetween at least one display area;

a base for supporting the display frame;

means foor pivotably supporting the display frame on the base along a pivot axis;

first and second stops, the first stop positioned on one side of the display frame forward of the pivot axis, the second stop positioned on the opposite side of the display frame aft of the pivot axis such that the second stop is diagonally opposite the first stop;

a first spring having a first end, a second end, and an intermediate coil;

means for mounting the first spring between the display frame and the base, such that the first end engages the first stop and tightens the coil of the first spring when the display frame is pivoted forward of an upright position and the first end disengages and rotates away from the first stop when the display frame is pivoted backward from an upright position in order that the first spring and the first stop cooperate to restore the display frame to an upright position when the display frame is tilted forward, without unwinding the first spring;

a second spring, having a first end, a second end and an intermediate coil;

means for mounting the second spring between the display frame and the base, such that the first end engages the second stop surface and tightens the coil of the second spring when the display frame is pivoted backward of an upright position and the second end disengages and rotates away from the second stop when the display frame is pivoted forward of an upright position in order that the second spring and second stop cooperate to restore the display frame to an upright position when the display frame is tilted backward, without unwinding the second spring.

5. The portable sign of claim 4 whereiin each of the first and second springs is concentric with the means for pivotably mounting the display frame to the base.

6. The portable sign of claim 4 or 5 wherein the means for pivotably mounting the display frame to the base comprises at least one shaft.

7. A portable sign comprising:

a display frame including two uprights, and at least one cross-member rigidly interconnecting the uprights;

a base having two sides and defining front and rear ends including first and second upright members, each upright member having a pair of legs positioned so that the legs form at their apex an included approximately right angle;

first and second shafts;

means for pivotably mounting the first shaft between the display frame and the base;

means for pivotably mounting the second shaft between the display frame and the base such that the first and second shafts are colinear and define a pivot axis;

first and second stops defined by legs on the first and second upright members, respectively of the base, the first stop located on one side of the base forward of the pivot axis and the second stop located on the opposite side of the base aft of the pivot axis such that said second stop is diagonally opposite said first stop with respect to the axis defined by the shafts;

a first spring having a first end, a second end and an intermediate coil;

means for attaching the first end of the first spring to the display frame such that the intermediate coil is concentric with the first shaft and the second end of the first spring resists against the first stop, engages the first stop, and tightens the coil of the first spring when the display frame is pivoted forward of an upright position, and further, such that the second end of the first spring disengages and rotates away from the first stop when the display frame rotates backward from an upright position in order that the first spring and first stop cooperate to restore the display frame to the upright position when the display frame is tilted forward of the upright position, without unwinding the coil when the display frame is tilted backward from the upright position;

a second spring, having a first end, a second end and an intermediate coil;

means for attaching the first end of the second spring to the display frame, such that the intermediate coil is concentric to the shaft and the second end of the second spring resists against the second stop, engages the second stop and tightens the coil of the second spring when the display frame is pivoted backward from the upright position, and further, such that the second end of the second spring disengages and rotates away from the second stop when the display frame rotates forward of the upright position in order that the second spring and the second stop cooperate to restore the display frame to the upright position when the display frame is tilted backward from the upright position without unwinding the coil when the display frame is tilted forward of the upright position.

8. A portable sign comprising:

a display frame defining front and rear display areas, including first and second uprights and at least one cross member rigidly interconnecting the uprights, each upright having a shaft rigidly mounted thereon such that the shafts are substantially perpendicularly with respect to the upright;

a base defining a front end and a rear end, the base including:

left and right upright members, each upright member formed from tubing to define first and second angularly extending portions forming an included approximately right angle, third and fourth downwardly extending portions, and fifth and sixth outwardly extending portions for engaging the ground;

a first cross member interconnecting the left and right upright members along the front end of the base;

a second cross member interconnecting the left and right upright members along the rear end of the base;

a pair of bushings for pivotally receiving the shafts extending from the display frame, the first bushing mounted on the base near the apex defined by the left upright, and the second bushing mounted on the base near the apex defined by the right upright;

the first and second angularly extending members on the left and right upright members defining first and second stops on each side of the base, the first stop on the one side of the base adjacent the front end of the base and the second stop on the other side of the base adjacent the rear end of the base, such that the first stop on one side of the base is diagonally opposite the second stop on the other side of the base with respect to an axis defined by the shafts;

a first spring having a first end, a second end and an intermediate coil, the first end attached to the first upright of the display frame, the intermediate coil surrounding the shaft such that the second end of the first spring resists against the first stop and tightens the coil when the first spring is pivoted forward of an upright position and the second end disengages and rotates away from the first stop toward the second stop on the first upright when the display frame rotates backward from an upright position in order that the first spring and the first stop cooperate to restore the display frame to the upright position when the display frame is tilted backward from the upright position without unwinding the coil when the display frame is tilted backward from an upright position;

a second spring, having a first end, a second end, and an intermediate coil, the first end attached on the opposite side of the display frame, the coil surrounding the shaft and the second end of the second spring resists against the second stop, engages said stop and tightens the coil of the second spring when the display frame is pivoted backward from the upright position, and the second end of the second spring disengages and rotates away from the second stop when the display frame rotates forward of the upright position such that the second spring and the second stop cooperate to restore the display frame to the upright position when the display frame is tilted backward from the upright position without unwinding the coil when the display frame is tilted forward of the upright position.

9. A portable display sign comprising:

a display frame;

a base for supporting the display frame;

means for pivotally connecting the display frame to the base;

a first stop surface on one side of the base;

a second stop surface on the other side of the base offset with respect to the first stop surface;

a first spring having one end connected to the display frame and including a coil and a second end which engages the first stop surface and tightens the coil to provide a force for restoring the display frame when the display frame is pivoted in a forward direction, and which disengages from the first stop surface when the display frame is pivoted in a rearward direction in order that substantially no unwinding forces are applied to the coil of the first spring by movement of the display frame;

a second spring having one end connected to the opposite side of the display frame, and having a coil and a second end which engages the second stop surface and tightens the coil to provide a force for restoring the display frame when the display frame is pivoted in a rearward direction and which disengages from the second stop surface when the display frame is pivoted in a forward direction in order that substantially no unwinding forces are applied to the coil of the second spring by movement of the display frame.

10. The portable sign of claims 1, 7, 8 or 9 further including a cover for each spring for preventing against insertion of foreign objects into the springs.

* * * * *

UNITED STATES PATENT AND TRADEMARK OFFICE

CERTIFICATE OF CORRECTION

PATENT NO. : 4,365,435

DATED : Dec. 28, 1982

INVENTOR(S) : H. Kent Snyder, Jr.

It is certified that error appears in the above—identified patent and that said Letters Patent is hereby corrected as shown below:

In column 4 line 21 please delete "14" and insert therefor --4--. In claim 1 line 59 please delete the first "an" and insert therefor --and--. In claim 4 line 29 please delete "foor" and insert therefor --for--. In claim 5 line 63 please delete "whereiin" and insert therefor --wherein--.

Signed and Sealed this

*Twenty-third* Day of *August 1983*

[SEAL]

*Attest:*

GERALD J. MOSSINGHOFF

*Attesting Officer*

*Commissioner of Patents and Trademarks*